United States Patent [19]

Drori

[11] 4,012,176

[45] Mar. 15, 1977

[54] FLUID-DRIVEN MOTOR AND FERTILIZER FEEDING DEVICE UTILIZING SAME

[76] Inventor: Mordeki Drori, 89 Zahal St., Kiron, Israel

[22] Filed: Feb. 21, 1975

[21] Appl. No.: 551,999

[30] Foreign Application Priority Data

Mar. 8, 1974 Israel ..... 44372

[52] U.S. Cl. ..... 417/405; 137/101.31; 222/57; 222/334; 417/477

[51] Int. Cl.[2] ..... F04B 17/00

[58] Field of Search ..... 417/405, 406, 474–477; 92/13.2; 222/57, 234; 137/98, 101.31

[56] References Cited

UNITED STATES PATENTS

| | | | |
|---|---|---|---|
| 315,667 | 4/1885 | Serdinko | 417/475 |
| 2,466,618 | 4/1949 | Stocks | 417/475 |
| 2,696,173 | 12/1954 | Jensen | 417/477 |
| 2,893,356 | 7/1959 | Murray | 417/475 |
| 3,303,748 | 2/1967 | Duryee et al. | 417/477 |
| 3,431,864 | 3/1969 | Jones | 417/477 |
| 3,654,959 | 4/1972 | Kassel | 137/101.31 |

*Primary Examiner*—C. J. Husar
*Attorney, Agent, or Firm*—Benjamin J. Barish

[57] ABSTRACT

A fluid-driven motor comprises a collapsible tube connectable at one end to a source of pressurized fluid, and a pinch-roller engaging the outer surface of the tube and collapsing same at the point of engagement, whereby the pressure within the tube drives the pinch-roller and a mechanical power output device coupled thereto. In the described preferred embodiment, the pinch-roller mounting is a rotary one and supports a plurality of pinch-rollers, the collapsible tube being supported in a semi-circular form so as always to be engageable by at least one of the pinch-rollers.

Also described is a feeding device, for example for feeding fertilizer material into a water-irrigation line, the fluid-driven motor including a second collapsible tube receiving the material to be fed, and a second plurality of pinch-rollers supported closer to the rotational axis than the first-mentioned pinch-rollers, the second pinch-rollers engaging a second collapsible tube for feeding the fertilizer material therethrough, the pinch-rollers being so related to their respective collapsible tubes so as to amplify the force derived from the pressurized tube and applied to the feeding tube.

10 Claims, 6 Drawing Figures

FLUID-DRIVEN MOTOR AND FERTILIZER FEEDING DEVICE UTILIZING SAME

BACKGROUND OF THE INVENTION

The present invention relates to a novel form of fluid-driven motor, and also to a fertilizer feeding device utilizing the novel motor.

Many types of fluid-driven motors are known, e.g., turbines and piston-cylinder arrangements, for converting the energy of a fluid into mechanical power. There are many applications, however, where such known fluid-driven motors are subject to conditions which create serious difficulties in their use or even preclude their use.

One such application is in feeding fertilizer material into a water-irrigation line. In such an application, it is highly desirable to use the energy in the pressurized water line for feeding the fertilizer, to avoid the need of a mechanically-driven or electrically-driven pump in the field. The fertilizer mixture which is to be added into the water-irrigation line, however, is usually in the form of a slurry which has a large tendency to clog the feeding pump thereby producing serious field maintenance problems. Moreover, the conventional pumps heretofore used for this purpose are usually of complicated and costly construction.

An object of the present invention is to provide a novel fluid-driven feeding device having advantages in some or all of the above respects.

SUMMARY OF THE INVENTION

The fluid-driven feeding device of the present invention is particularly useful in feeding fertilizer mixtures into a water irrigation line, and is therefore described below with respect to that application. It will be appreciated, however, that the invention itself, or various aspects thereof, could advantageously be used in other applications.

According to the present invention there is provided a fluid-driven feeding device comprising a housing, a rotor rotatably mounted therein, a pair of collapsible tubes each having a loop disposed within the housing, and pinch rollers carried by the rotor, and engagable with the loops the tubes. One collapsible tubes is a pressurized tube, having one end connectable to a source of pressurized fluid and the opposite end vented to the atmosphere. The second collapsible tube is a feeding tube having one end connectable to a source of fluid material to be fed therethrough and through the opposite end. The pinch rollers carried by the rotor are engagable with the loops of both collapsible tubes such that the pressurized fluid in the pressurized tube acts on the pinch rollers to rotate the rotor causing same as it rotates to collapse the feeding tube and thereby to feed the fluid material therethrough.

According to another feature of the invention, the pinch rollers, are related to the collapsible tubes such as to amplify the force derived by the rotor from the pressurized tube and applied by the rotor to the feeding tube. Several arrangements are illlustrated below for producing this amplification of the force.

According to a further feature, pinch-rollers comprise a first group engagable with the pressurized collapsible tube and a second group engagable with the feeding collapsible tube, the first group of rollers being supported at a smaller distance from the rotational axis of the rotor than the second group of pinch rollers engagable with the feeding tube so as to amplify the force derived from the pressurized tube and applied to the feeding tube.

Another embodiment is described wherein the feeding tube is of smaller cross-sectional area than the pressurized tube so as to amplify the force derived from the pressurized tube and applied to the feeding tube. In the latter embodiment the pinch-roller engagable with the collapsible feeding tube is preferably a part of and constitutes an extension of the pinch-roller engagable with the collapsible pressurized tube, the feeding tube being disposed in side-by-side relationship to the pressurized tube.

A still further embodiment is descirbed wherein the feeding tube is disposed within and constitutes a part of the pressurized tube, the latter including a partition wall to define the feeding tube.

A fluid-driven motor constructed in accordance with the foregoing features of the invention provides a number of advantages over the prior known motors, which advantages are particularly important in feeding fertilizer mixtures into a water irrigation line. One important advantage in this application is the fact that the fertilizer mixture itself never comes into contact with parts of the fluid-driven motor and therefore cannot clog the motor or the pump driven thereby. Thus the maintenance problem is very substantially reduced. Another very important advantage is that the motor and feeding device utilize relatively few and simple parts which can be constructed at a very low cost.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
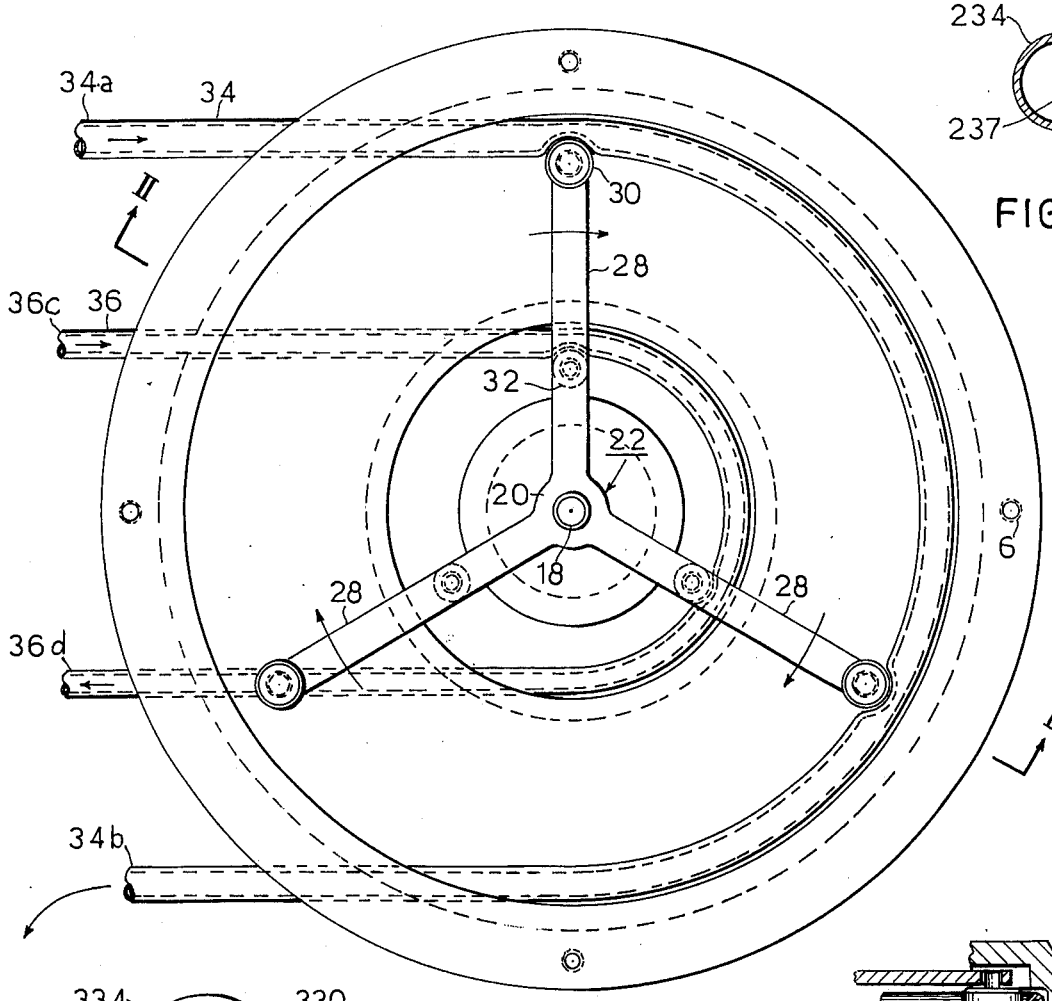
FIG. 1 is a plan view, with the upper housing plate removed, of a fertilizer feeding device including a fluid-driven motor constructed in accordance with the invention.
Figure 2:
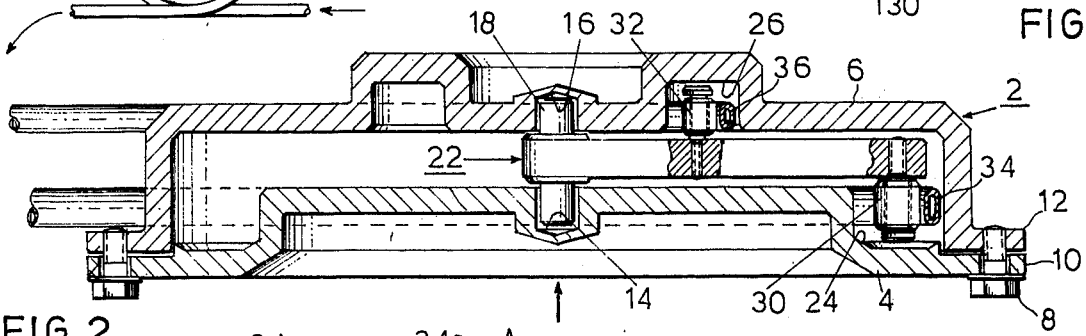
FIG. 2 is a sectional view of the fertilizer feeding device along lines 11—11 of FIG. 1.
Figure 3:
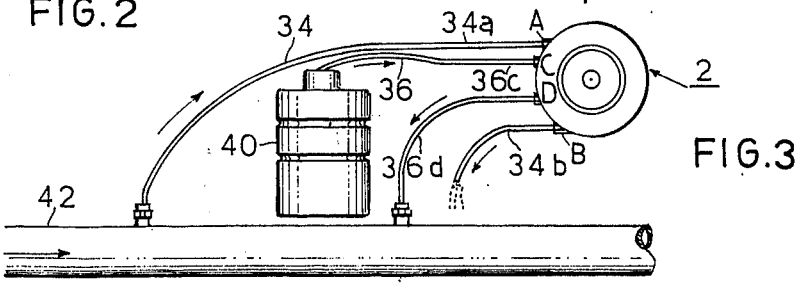
FIG. 3 illustrates the feeding device in use for feeding a fertilizer mixture into a water irrigation lines.

Embodiment of FIGS. 1–3

The fertilizer feeding device illustrated in FIGS. 1 and 2 comprises a housing, generally designated 2, made of two circular plates or sections 4, 6, secured together by bolts 8 passing through flanged rims 10, 12 formed on the plates. The two plates are further formed with central sockets 14, 16 for rotatably receiving a stub shaft 18 carried by the hub 20 of a rotor, generally designated 22. Plate 4 is also formed with an outer annular recess 24 at its outer periphery, and plate 6 is formed with an inner annular recess 26 intermediate its outer periphery and its socket 16.

Hub 20 of rotor 22 carries three radial arms 28 disposed at 120 angular degrees from each other. Each radial arm includes an outer pinch-roller 30 movable within the outer recess 24 of plate 4, and an inner pinch-roller 32 movable within the inner recess 26 of plate 6. It will thus be seen that as rotor 22 rotates, the three outer rollers 30 move within outer recess 24, and the three inner rollers 32 move within recess 26.

As shown particularly in FIG. 2, the outer recess 24 serves as an outer channel for receiving a flexible tube 34, which tube enters the housing from one side, makes a semi-circular wrap or loop within channel 24, and exits from the same side of the housing. Inner recess 26 serves as an inner channel for receiving a second flexible tube 36, which tube enters the housing from the same side as tube 34, makes a semi-circular wrap or loop within channel 26, and exits from the same side of the housing.

Both flexible tubes 34 and 36 are easily collapsible, and may be made, for example, of rubber.

The tubes 34 and 36 are inserted into the housing so that they pass through the space between their respective pinch-rollers 30, 32, and a wall of the respective recess 24, 26, the dimensions being such that the rollers press their respective tube against the respective recess wall and thereby collapse the tube.

FIG. 3 illustrates the manner of using the feeding device of FIGS. 1 and 2 for feeding fertilizer materials from a container 40 into the water of an irrigation line 42, while using the energy of the water in the pressurized line for driving the feeding device.

As can be seen in FIG. 3, the feeding device has four connections, marked A, B, C and D. Connections A and B are used for flexible tube 34, which tube is connected at one end 34*a* to the water line 42, the opposite end 34*b* vented to the atmosphere. Connections C and D are used for flexible tube 36, end 36*c* of the tube being connected to the fertilizer container 40, and end 36*d* of the tube being connected to the water line 42.

It will be seen that the pressurized water passing through end 34*a* of tube 34 applies a driving force to the first outer pinch-roller 30 collapsing the tube in its path (i.e. the uppermost one in FIG. 1), moving the roller, and thereby the complete rotor 22 to which it is attached, in the direction of the low pressure end (34*b*) of the tube, i.e., clockwise in FIG. 1. As rotor 22 is rotated, this same driving force is applied successively to the other outer pinch-rollers 30 of the rotor. Thus the pressurized water in tube 34 continuously rotates rotor 22.

As rotor 22 rotates, the inner pinch-rollers 32, which engage the fertilizer feeding tube 36, similarly collapses the feeding tube at their respective points of engagement. The fertilizer is thereby drawn from its container 40, via end 36*c* of tube 36, and is forced out through end 36*d* into the water irrigation line 42.

Since the inner rollers 32 engaging the fertilizer feeding tube 36 are located at a smaller distance from the centre axis of rotation (shaft 18) of roller 28 then the outer rollers 30 engaging the pressurized tube 34, the feeding force derived from the pressurized tube will be amplified, and therefore a greater pressure will be produced for injecting the fertilizer material into the water line 42 than the pressure existing in the water line. For example, if the pressure in the water line is 3.0 atmospheres, the feeding device could be designed so as to force the fertilizer material into the water line at a pressure of about 3.5 atmospheres.

It will be appreciated that the device illustrated in FIGS. 1 and 2 is actually a fluid-driven motor which receives its input energy from the pressurized water line 32 and applies a mechanical power output via rotor 22 for driving another device. In this case, the latter is a device for pumping or feeding fertilizer material (via rollers 32) into the pressurized water line. The fluid-driven motor illustrated, however, could be used for driving other types of devices, by merely coupling rotor 22, for example its shaft 18, to the device to be driven thereby. Thus the fluid-driven motor illustrated may be used for driving a conventional pump, by connecting the input shaft of the pump to shaft 18 of rotor 22.

Figure 5:
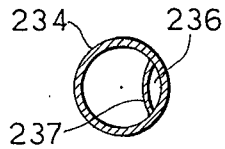
FIGS. 4, 5 and 6 illustrate variations in the device of FIGS. 1–3.
Figure 6:
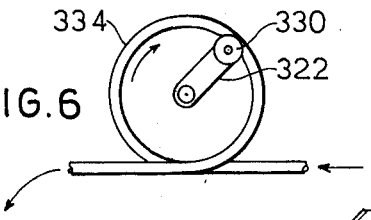
Figure 4:
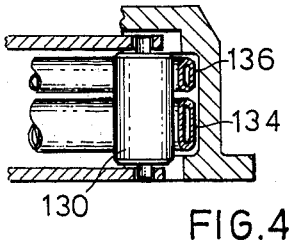

Embodiments of FIGS. 4–6

Many variations in the device illustrated in FIGS. 1 and 2 may be made. FIGS. 4–6 illustrate three variations for purposes of example.

FIG. 4 illustrates the variations wherein the feeding pinch-roller (32) is a part of or continuation of the driving pinch-roller (30), this being shown by pinch-roller 130 in FIG. 4. In this case, the feeding tube 136 is of smaller cross-sectional area than the pressurized driving tube 134, so as the amplify the force derived from the pressurized tube and applied to the feeding tube in order to feed the fertilizer material into the water line at a higher pressure than existing in the water line.

FIG. 5 illustrates a similar arrangement as in FIG. 4, except that the feeding tube 236 is disposed within and constitutes a part of the pressurized driving tube 234, the feeding tube being defined by a partition 237 formed within the pressurized tube 234.

FIG. 6 illustrates a further variation wherein the rotor, generally designated 322, includes a single pinch-roller 330, rather than the three pinch-rollers (30) in FIGS. 1 and 2. In this case, the pressurized tube 334 is supported to form a complete circle so as to be continuously engaged by roller 330 during the rotation of rotor 322.

The variation of FIG. 6 only illustrates the fluid-driven motor part of the device, i.e., without the rollers (32 in FIGS. 1 and 2) engageable with the feeding tube (36) for feeding the fertilizer material. As in the other described embodiments, the motor of FIG. 6 can be used for mechanically driving other devices by coupling same to its rotor 332. It also may be used for feeding fertilizer by merely including another pinch-roller (corresponding to 32 in FIGS. 1 and 2) on rotor 322 engageable with a feeding tube (corresponding to 36 in FIGS. 1 and 2), the latter also assuming a full circular form as the pressurized tube 334.

Many other variations and applications of the illustrated embodiments will be apparent.

What is claimed is:

1. A fluid-driven feeding device comprising: a housing; a rotor rotatably mounted within the housing; a collapsible pressurized tube having a loop disposed within the housing, one end of the pressurized tube being connectable to a source of pressurized fluid and the other end being vented to the atmosphere; a collapsible feeding tube having a loop disposed within the housing, one end of the feeding tube being connectable to a source of fluid material to be fed therethrough and through the opposite end thereof; and pinch roller means carried by the rotor and engageable with said loops of both collapsible tubes whereby the pressurized fluid in the collapsible pressurized tube acts on the pinch roller means to rotate the rotor causing same as it rotates to collapse the feeding tube and thereby to feed the fluid material therethrough.

2. A feeding device according to claim 1, wherein said pinch roller means comprises a first group of pinch rollers engageable with the pressurized collapsible tube and a second group of pinch rollers engageable with the feeding collapsible tube, said second group of pinch rollers being supported on said rotor at a smaller distance from the rotational axis of the rotor than said first group whereby the force derived by the rotor from the pressurized tube and applied by the rotor to the feeding tube is amplified.

3. A feeding device according to claim 2, wherein said housing is formed with an outer circular channel for receiving the loop of the collapsible pressurized tube and with an inner circular channel for receiving the loop of the collapsible feeding tube, said first group of pinch rollers carried by the rotor being rotatable within said outer channel, and said second group of pinch rollers carried by the rotor being rotatable within said inner channel.

4. A feeding device according to claim 3, wherein the housing is made of two sections joined together, the outer channel being formed in one section and the inner channel being formed in the other section.

5. A feeding device according to claim 3, wherein said rotor includes a plurality of radial arms each carrying a pinch roller of the first group and a pinch roller of the second group.

6. A feeding device according to claim 5, wherein the rotor includes three radial arms equally spaced at 120 angular degrees from each other, each of said tube loops being substantially semicircular.

7. A feeding device according to claim 1, wherein the collapsible feeding tube is of smaller cross-sectional area than the collapsible pressurized tube whereby the force derived by the rotor from the pressurized tube and applied by the rotor to the feeding tube is amplified.

8. A feeding device according to claim 1, wherein said pinch roller means includes a pinch roller engaging both said collapsible pressurized tube and said collapsible feeding tube, the cross-sectional area of said pressurized tube being larger than that of said feeding tube whereby the force derived by the rotor from the pressurized tube and applied by the rotor to the feeding tube is amplified.

9. A feeding device according to claim 8, wherein the collapsible feeding tube is disposed within and constitutes a part of the collapsible pressurized tube, the latter including a partition wall common to both collapsible tubes.

10. A feeding device according to claim 1, wherein said one end of the collapsible pressurized tube is connected to a pressurized water supply line, said one end of the collapsible feeding tube is connected to a liquid fertilizer supply, and said opposite end of the collapsible feeding tube is connected to the pressurized water supply line for feeding a liquid fertilizer material into same.

* * * * *